US007328775B2

(12) United States Patent
Zaharia et al.

(10) Patent No.: US 7,328,775 B2
(45) Date of Patent: Feb. 12, 2008

(54) DESTINATION ENTRY SYSTEM WITH DELAYED ELEVATOR CAR ASSIGNMENT

(75) Inventors: Vlad Zaharia, Rocky Hill, CT (US); Theresa Christy, West Hartford, CT (US); Richard Mangini, Brookfield, CT (US); Jannah Stanley, Cromwell, CT (US); Paul Stranieri, Bristol, CT (US); Wade Montague, Southington, CT (US)

(73) Assignee: Otis Elevator Company, Farmington, CT (US)

( * ) Notice: Subject to any disclaimer, the term of this patent is extended or adjusted under 35 U.S.C. 154(b) by 617 days.

(21) Appl. No.: 10/950,989

(22) Filed: Sep. 27, 2004

(65) Prior Publication Data

US 2006/0065491 A1 Mar. 30, 2006

(51) Int. Cl.
*B66B 1/34* (2006.01)

(52) U.S. Cl. ..... 187/396; 187/391

(58) Field of Classification Search ..... 187/391–396, 187/247, 248

See application file for complete search history.

(56) References Cited

U.S. PATENT DOCUMENTS 4,852,696 A * 8/1989 Fukuda et al. ..... 187/392
5,689,094 A 11/1997 Friedli et al.
6,945,365 B2 9/2005 Matela
7,036,635 B2 * 5/2006 Rintala et al. ..... 187/396
2001/0035314 A1 * 11/2001 Yoshida et al. ..... 187/382

FOREIGN PATENT DOCUMENTS

EP 1483190 B1 10/2006

* cited by examiner

*Primary Examiner*—Jonathan Salata
(74) *Attorney, Agent, or Firm*—Carlson, Gaskey & Olds

(57) ABSTRACT

An elevator system utilizes a destination entry control technique and delays indicating which car is assigned to a request to allow an individual to arrive near an elevator lobby. An elevator group assignment is made responsive to a destination request. An indication regarding the group assignment is provided to a passenger within a first time from the receipt of the request. A second indication regarding a car assigned to carry that passenger to the desired destination is provided at a second, later time from the request. Separating out the group assignment indication and the car assignment indication is accomplished in one example by providing separate interfaces at different locations within a building.

20 Claims, 1 Drawing Sheet

DESTINATION ENTRY SYSTEM WITH DELAYED ELEVATOR CAR ASSIGNMENT

FIELD OF THE INVENTION

This invention generally relates to elevator systems. More particularly, this invention relates to assigning cars in a destination entry system.

DESCRIPTION OF THE RELATED ART

Elevator systems are in widespread use throughout the world. Various system configurations and strategies are known for controlling passenger traffic and efficiently operating an elevator system.

Traditionally, hall call buttons allowed passengers to place a call to go up or down within a building and then to select a destination floor from a car operating panel located within an elevator car. While such arrangements are useful for many situations, larger buildings with more traffic volume have been shown to benefit from other control techniques. One example technique is known as destination entry.

In a destination entry system a passenger provides an indication of a desired destination outside of an elevator car. Most destination entry systems include destination entry kiosks within an elevator boarding area. A controller uses known techniques for assigning that passenger's travel to a particular elevator car. Various techniques for conveying the car assignment information and directing passengers to the appropriate car are known.

One situation where known destination entry systems have shortcomings is a situation where an individual places a destination request a significant distance from an assigned elevator car or a significant amount of time prior to the individual's arrival near the car. Known systems provide immediate feedback regarding a car assignment responsive to the passenger's request. Under such circumstances, an individual typically is required to remember the assigned elevator group and the assigned car within that group in order to reach their desired destination. Additionally, there can be a relatively large range of travel time for individual passengers to get to the appropriate elevator group. Therefore, timing the arrival of the assigned car to meet a passenger can be difficult.

A further complexity is introduced when considering that most destination entry systems include control algorithms that are designed to effectively look ahead a certain amount of time but they are not designed to assign cars more than a minute in advance of when the assignment is actually needed. Therefore, known elevator dispatchers including destination entry systems are not adequately equipped to provide feedback to passengers who will not actually board an elevator car for at least 45 seconds after placing a request to be carried to a particular destination.

This invention provides an improved arrangement that enhances the ability for directing passengers to particular elevator cars even when the passenger will not arrive in the vicinity of the car for some time after the elevator system controller receives the request regarding their intended destination.

SUMMARY OF THE INVENTION

An exemplary disclosed system for controlling elevator traffic includes a controller that automatically assigns an elevator car within a selected elevator group to carry a passenger to a desired destination responsive to a request to travel to the desired destination. The controller provides an indication of the assigned car after a selected time has expired since receipt of the request.

In one example, the controller provides a first indication of the selected elevator group to the passenger within a first time from the request. The controller provides a second indication of an assigned elevator car to the passenger at a second, later time from the request.

By providing an indication of the elevator group in advance of providing an indication of the assigned car, an individual passenger need only recall the elevator group to which their request has been assigned. Later, such as upon arrival in the vicinity of the elevator group, for example, the second indication notifies the passenger of the particular car that will travel to the desired destination. This arrangement facilitates allowing an individual to place a destination request well in advance of arriving in the vicinity of the actual elevator car that will carry them to their intended destination. The example arrangement also allows a controller to take into account various elevator system conditions occurring between receipt of a request and a car assignment to make a more efficient car assignment.

A disclosed method of directing elevator passengers responsive to requests to travel to destinations includes providing selected elevator group indication to at least one passenger within a first time from the request. An indication of the assigned elevator car is provided to the passenger at a second, later time after the request.

The various features and advantages of this invention will become apparent to those skilled in the art from the following detailed description. The drawing that accompanies the detailed description can be briefly described as follows.

DETAILED DESCRIPTION OF THE PREFERRED EMBODIMENT

Figure 1:
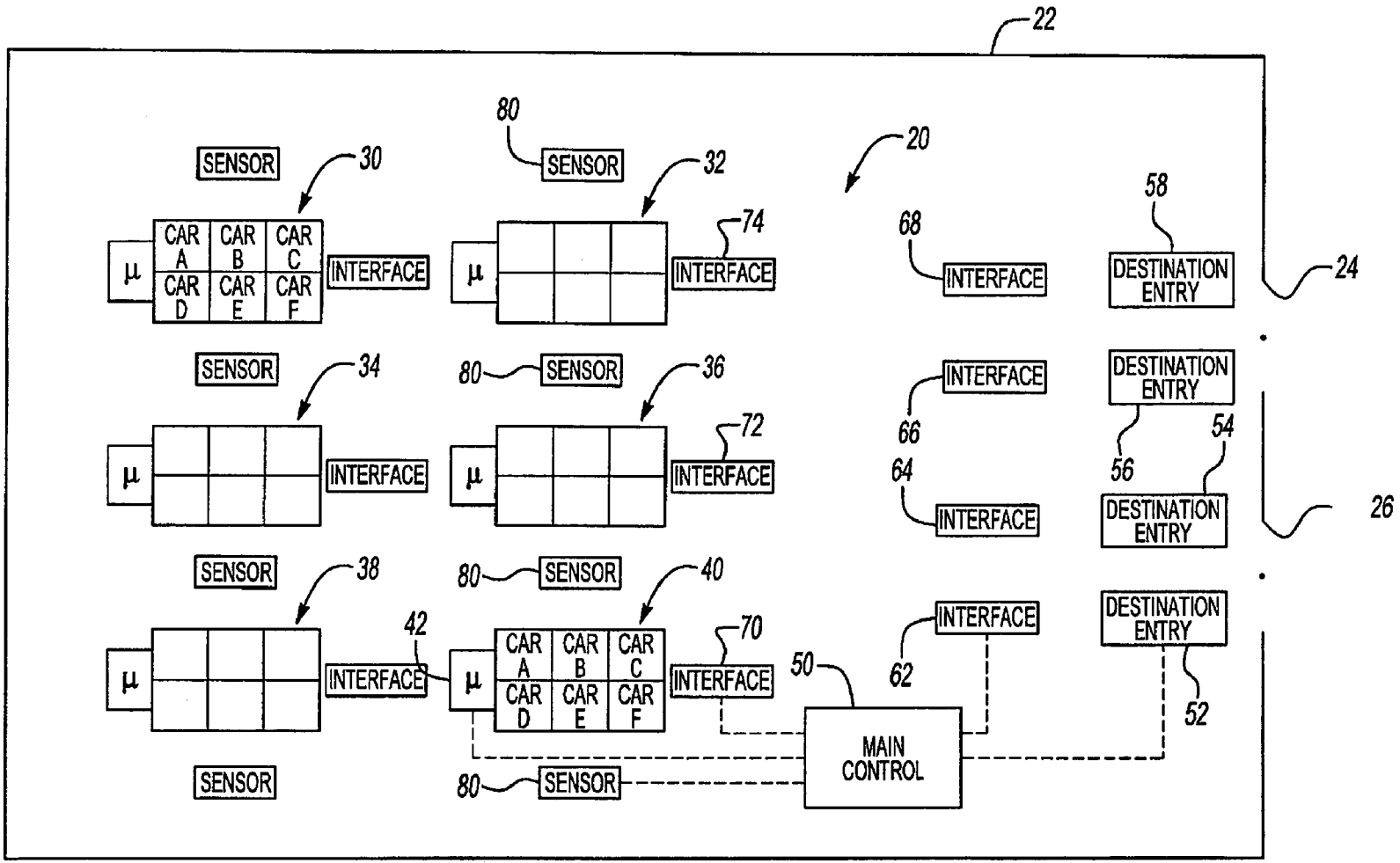
FIG. 1 schematically shows an example elevator system designed according to an embodiment of this invention.

FIG. 1 schematically shows an elevator system 20 within a building 22. A plurality of access points 24 and 26 (i.e., doorways) allow individuals to enter a portion of the building space. The access points 24 and 26 are located remotely and, in this example, a considerable, fixed distance from a plurality of elevator groups 30, 32, 34, 36, 38 and 40.

The example elevator system 20 includes controlling elevator car movement and directing passenger traffic using destination entry techniques. The example system is particularly well suited to directing passengers to their assigned car even when there is a considerable amount of time between when the passenger's destination request is received by the system and when the passenger arrives in the vicinity of an appropriate elevator car.

Considering the elevator group 40 as an example, a plurality of cars A-F are included within the group. Known techniques for assigning particular cars to particular floor destinations are used by a group controller 42. The group controller 42 communicates with a main control 50 for determining how many calls are assigned to that group. In one example, the main control 50 makes the car assignments. In another example, the group controllers make car assignments within their respective groups It should be noted that the various controllers schematically shown in FIG. 1 are divided up only for discussion purposes. In one example, a single controller may include a plurality of hardware or software modules that perform the various functions of the controllers schematically shown in FIG. 1. Those skilled in the art who have the benefit of this description will realize how to integrate or separate control components and functions to meet the needs of their particular situation.

In the example of FIG. 1, the main control 50 receives destination requests from individuals entering the building 22 at the access points 24 or 26. In the illustrated example, destination entry devices 52, 54, 56 and 58 are arranged to receive the passenger destination requests. In one example, the destination entry devices 52-58 include card readers that obtain information from cards carried by individuals and which include an indication of the identity of that individual. For example, one individual entering the building 22 may be required to report to a particular floor to begin work that day. The information on their destination entry card would be useful for determining the appropriate floor level to which they must report. In one example, a database accessible by the main control 50 includes destination information for each access card or each identity indication. In another example, the access card provides a signal that includes a direct indication of the destination request.

One advantage to the disclosed arrangement is that the destination entry devices 52-58 can be located immediately adjacent an access point to a building. They also may be integrated into a building security system which requires interaction with or operation of a particular device to gain access to the building space. In one example, the same input device that allows an individual to gain access to the building obtains the destination request in an automated fashion so that the individual need not make a separate request for purposes of placing an elevator call. Such an arrangement provides seamless integration of building access functions like security and elevator travel and maximizes traffic flow in the building.

The control 50 receives the destination requests and determines which of the elevator groups 30-40 will be assigned to carry that individual to the desired destination. A plurality of first interfaces 62, 64, 66 and 68 are provided in the illustrated example for providing an indication regarding the elevator group to which an individual's request has been assigned. In this example, the first interfaces 62-68 provide essentially immediate feedback to passengers regarding the elevator group that will service them for purposes of eventually arriving at their desired destination.

In one example, the first interfaces 62-68 include display screens for providing a visual indication to passengers regarding the assigned elevator group. In another example, the interfaces 62-68 provide an audible elevator group indication. The first interfaces 62-68 advantageously can be located near the access points 24 and 26 to the building. In one example, the interfaces 62-68 are placed near the entry devices 52-58 to provide feedback when passing through such devices. This allows an individual to obtain information regarding the elevator group assigned to their destination request upon entry into the building 22, for example.

In another example, no group indication is necessary and the interfaces 62-68 may not be needed.

As the individual passengers may take some time to arrive at the appropriate elevator group, the corresponding group controller 42 provides a separate indication of their assigned car approximately when the individual arrives or is expected to arrive in the vicinity of the appropriate elevator group. In the illustrated example, the second interfaces 70, 72 and 74 are provided near the respective elevator groups. The second interfaces 70-74 provide an indication to passengers regarding the car assigned to carry them to their desired destination. In one example, the second interfaces 70-74 provide a visual indication of cars and corresponding floors to which they will travel. Another example includes second interfaces that provide an audible indication of car assignments.

The main control 50 in one example controls the timing of providing the group assignment and the car assignments to the passengers. In another example, the corresponding group controller 42 controls the timing of the car assignment. The indication regarding the assigned group is provided within a first time from receiving the request. The indication regarding the assigned car is provided at a second, later time after receiving the request. Providing the group indication and the car indication at separate times facilitates allowing the individual to arrive at the appropriate elevator car location without requiring them to recall the group and car assignments over time.

In one example, the control 50 times the provision of the indication regarding the assigned car with an expected, average arrival time of a passenger at the elevator groups based on a distance from the location where the destination requests are received. In another example, the control 50 customizes the display of the assigned car indications based on an estimated or actual arrival of a passenger near the appropriate elevator group.

The example of FIG. 1 includes a plurality of sensors 80 positioned near the elevator groups for detecting the presence of passengers who place a particular destination request. In one example, a so-called smart card provides a wirelessly transmitted radio frequency signal that at least identifies the passenger in some manner. The controller uses a database to determine a destination request corresponding to the identity information. In another example, the signal from the card contains an actual destination request indication. In either example, the sensors 80 detect signals automatically transmitted by such cards and the control 50 or the group controller 42 determines when the individual carrying each card is within the vicinity of the assigned elevator group. At that time, the control 50 or group controller 42 determines that it is appropriate to display the assigned car indication or otherwise to provide it in a manner to direct that passenger to the assigned car.

In another example, sensors 80 are located within the building space in a manner to allow tracking an individual's approach to the appropriate elevator group. Such an arrangement provides additional options for timing when to provide the indications of the car assignment.

In one example system, the control 50 and any of the group controllers 42 can determine the assigned group and assigned car simultaneously responsive to the destination request. In one example, the group assignment is made at some time before making the actual car assignment. In this example, the appropriate controller has time to consider what has occurred since the destination request was placed before making the car assignment. This allows for more efficient car assignments because the elevator traffic between the time the request was placed and the time of estimated or actual arrival of the passenger near the elevator groups may impact the best car selection, for example. Making the car assignment at a later time from making the group assignment allows for such an example system to further maximize the system efficiency and passenger service.

Another advantage to the disclosed examples are that they can be used in parallel with one or more known destination entry systems.

The preceding description is exemplary rather than limiting in nature. Variations and modifications to the disclosed examples may become apparent to those skilled in the art that do not necessarily depart from the essence of this invention. The scope of legal protection given to this invention can only be determined by studying the following claims.

We claim:

1. A method of directing elevator passengers responsive to a request to travel to a destination, comprising:

providing an assigned elevator car indication responsive to the request after a selected waiting time since receipt of the request;

providing an assigned elevator group indication to at least one passenger within a first time from the request; and providing the assigned elevator car indication to the passenger at a second, later time from the request.

2. The method of claim 1, including providing the assigned elevator group indication at a first location and providing the assigned elevator car indication at a second location remote from the first location.

3. The method of claim 1, including receiving the request near an access point to a building space, providing the assigned elevator group indication near the access point and providing the assigned elevator car indication near the assigned elevator group.

4. The method of claim 1, including simultaneously, automatically assigning the elevator group and the elevator car.

5. The method of claim 1, wherein a difference in time between the first and second times is preselected.

6. The method of claim 1, wherein a difference in time between the first and second times varies responsive to a time associated with the passenger approaching the assigned elevator group after the request.

7. The method of claim 6, including determining when the passenger approaches the assigned elevator group and responsively controlling the second time.

8. The method of claim 7, including receiving a wirelessly transmitted signal indicating when the passenger approaches the assigned elevator group.

9. The method of claim 1, including automatically assigning the elevator car based at least in part on information regarding at least one of another passenger request received after assigning the elevator group or an elevator system condition occurring between the first and second time.

10. A method of directing elevator passengers responsive to a request to travel to a destination, comprising:

automatically receiving the request when granting the passenger access to a building space; and providing an assigned elevator car indication responsive to the request after a selected waiting time since receipt of the request.

11. A system for controlling elevator traffic, comprising:

a controller that automatically assigns an elevator car within a selected elevator group to carry a passenger to a desired destination responsive to a request to travel to the desired destination, provides a first indication of the selected elevator group to the passenger within a first time from the request and provides a second indication of an assigned elevator car to the passenger at a second, later time from the request.

12. The system of claim 11, including a first interface for providing the first indication and a second interface for providing the second indication.

13. The system of claim 12, wherein the first and second interfaces are remotely located from each other.

14. The system of claim 12, wherein the second interface is located near the selected elevator group.

15. The system of claim 11, wherein the controller delays providing the second indication for a selected amount of time after the request.

16. The system of claim 11, wherein the controller determines a time between the request and an arrival of the passenger near the selected elevator group and uses the determined time to control the second time.

17. The system of claim 16, wherein the controller uses a receipt of a wirelessly transmitted signal that is indicative of the arrival of the passenger near the selected elevator group.

18. The system of claim 11, wherein the controller automatically receives the request when the passenger accesses a building space using a device that provides a signal to the controller indicative of at least an identifier of the passenger and the controller uses the signal to determine the request.

19. The system of claim 11, wherein the controller assigns the elevator car based at least in part on information regarding at least one of another passenger request received after providing the first indication or an elevator system condition occurring after providing the first indication.

20. An elevator system, comprising:

a destination entry device that allows a passenger to request elevator service to a selected destination, the destination entry device being remotely located from an elevator lobby; and a controller that responds to the request by assigning an elevator car to travel to the selected destination, the controller providing an indication of the assigned car at a selected waiting time after receipt of the request, the waiting time being determined at least in part responsive to an indication of an arrival of the passenger near the elevator lobby corresponding to the assigned car.

* * * * *